United States Patent [19]

Goldfarb

[11] Patent Number: 5,032,100

[45] Date of Patent: Jul. 16, 1991

[54] TOY VEHICLE AND LAUNCHER USING CONTRACTIVE POWER OF LIQUID EXPANDED CHAMBER TO PROPEL VEHICLE

[76] Inventor: Adolph E. Goldfarb, 1432 S. Eastwind Circ., Westlake Village, Calif. 91361

[21] Appl. No.: 474,528

[22] Filed: Feb. 2, 1990

[51] Int. Cl.[5] ..... A63H 29/14

[52] U.S. Cl. ..... 446/187; 446/211

[58] Field of Search ..... 446/211, 212, 186, 187, 446/430, 429, 180, 176; 124/57, 69

[56] References Cited

U.S. PATENT DOCUMENTS

| | | | |
|---|---|---|---|
| 661,252 | 11/1900 | Shortridge | 446/186 |
| 2,101,646 | 12/1937 | Gordon, Jr. | 446/187 X |
| 2,505,526 | 4/1950 | Costea | 446/187 |
| 2,733,699 | 2/1956 | Krinsky | 446/212 X |
| 2,788,613 | 4/1957 | Gelfand et al. | 446/429 |
| 3,510,980 | 10/1965 | Pippin, Jr. | 446/211 |
| 3,740,896 | 6/1973 | Glass et al. | 446/212 |
| 3,820,275 | 6/1974 | Green | 446/212 |

*Primary Examiner*—Mickey Yu

*Attorney, Agent, or Firm*—Ashen Martin Seldon Lippman & Scillieri

[57] ABSTRACT

A toy vehicle and launcher combination apparatus. The illustrated toy vehicle has a rubber bladder or chamber member that is expanded by water or other liquid under pressing while the vehicle is held on the launcher. The launcher may include a reservoir and pump to provide the water under pressure. When the chamber member is sufficiently expanded, the vehicle is released. A spring gives the vehicle an initial forward thrust; the expanded chamber member contracts to expel the water through a rear outlet nozzle to propel the vehicle forward at a rapid rate.

13 Claims, 4 Drawing Sheets

FIG.

TOY VEHICLE AND LAUNCHER USING CONTRACTIVE POWER OF LIQUID EXPANDED CHAMBER TO PROPEL VEHICLE

BACKGROUND OF INVENTION

There have been toy vehicles in the past which utilized water to aid in propelling the vehicle forwardly. Typically such devices introduce water under pressure into a chamber to thereby compress the water and air trapped in the chamber. Then the device was allowed to expel the water from the chamber by virtue of the expansion of the compressed water and air. The toy vehicle was thereby propelled fowardly. The performance of the prior art devices was good. They depended for their operation on the compressibility of the water and the air in the chamber and the subsequent expansion of the compressed water and air. While such devices did work, well their performance did leave room for improvement. This was because the amount of energy provided by the compression and release of the air and water did not propel the air and water from the chamber at a very fast rate relative to the size and weight of the vehicle to be propelled. In other words, for a give size vehicle and a give quantity of water and air in a compartment in relative scale to that toy vehicle, the amount of thrust or forward power developed for the vehicle was relatively small.

SUMMARY OF INVENTION

The present invention contemplates utilizing not only the compressed force of water and air in a chamber, but the relatively large compressive force of the walls of the expanded chamber. When the outlet or nozzle at the rear of the expanded chamber is opened, the chamber walls compress inwardly against the water and air to expel the water and air from the chamber, to thereby drive the toy vehicle forwardly at great acceleration and velocity.

IN THE DRAWINGS

DETAILED DESCRIPTION OF THE DRAWINGS

Figure 1:
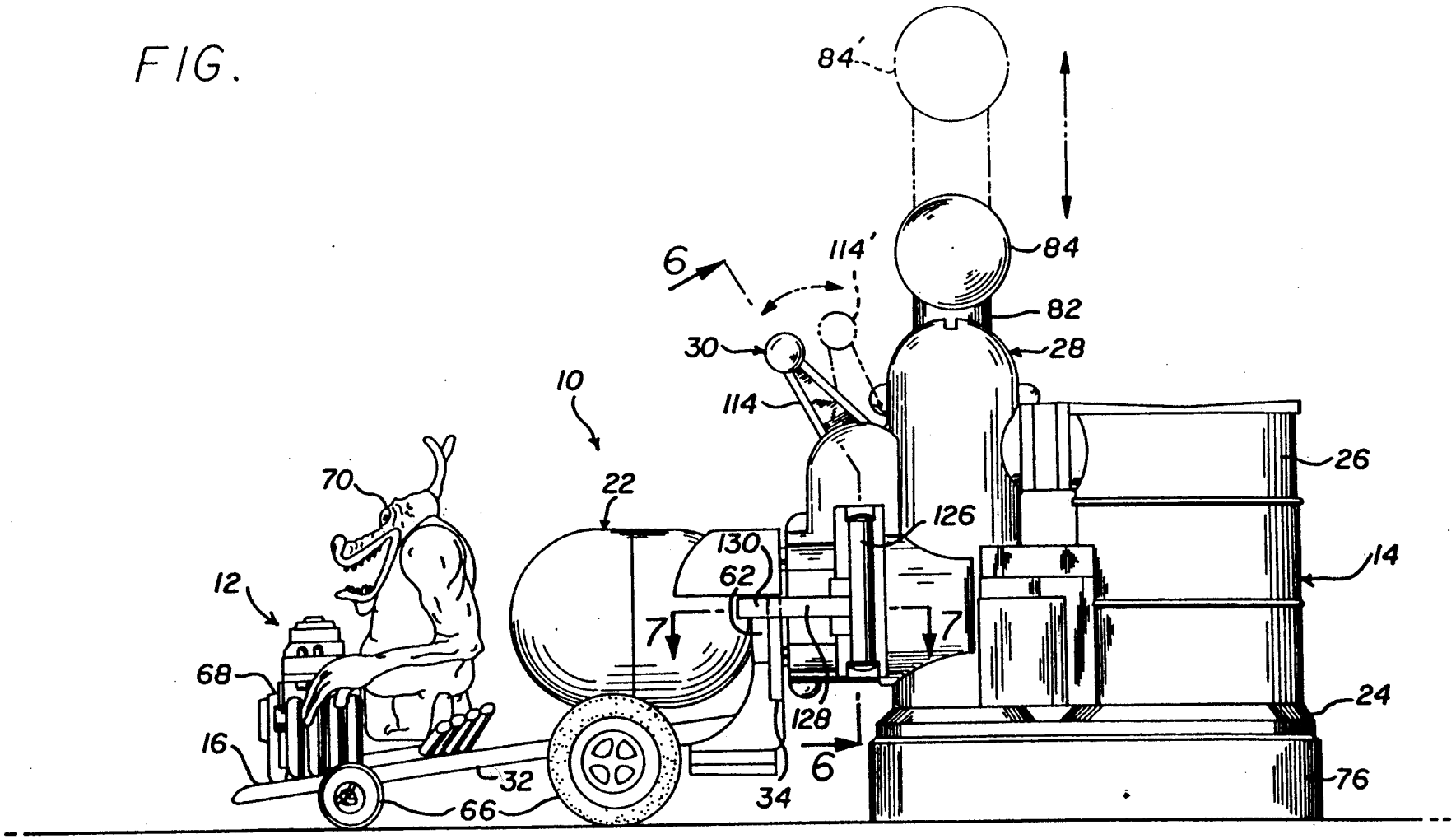
FIG. 1 is a side elevational view of a toy vehicle and launcher apparatus comprising a presently preferred embodiment of the invention.

In general, as shown in FIG. 1, the illustrated apparatus 10 comprises a toy vehicle 12 and a launcher 14 for holding and then releasing the vehicle.

Broadly, the vehicle 12 comprises a wheel mounted frame 16 which supports an expandable/contractible chamber 18 that has an inlet/outlet 20. The chamber 18 is surrounded by an enclosure 22 that protects the chamber and limits its expansion.

Figure 2:
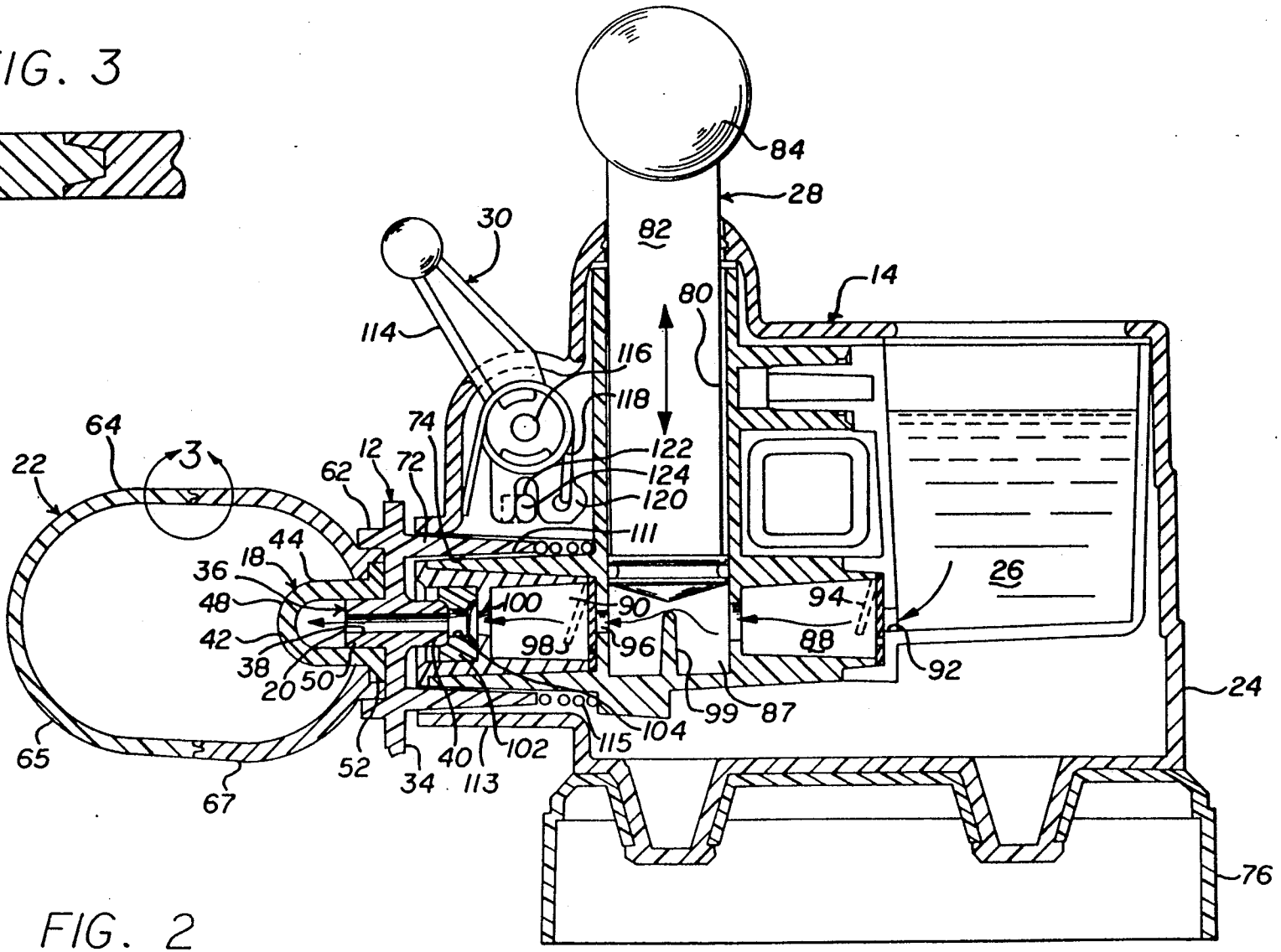
FIG. 2 is an enlarged longitudinal sectional view through portions of FIG. 1.
Figure 3:
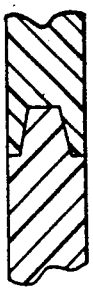
FIG. 3 is a further enlarged view of the area indicated by line 3—3 in FIG. 2.

In broad terms, referring to FIG. 2, the launcher 14 includes a base 24 that supports a reservoir 26 for liquid such as water and a pump mechanism 28 for taking water from the reservoir and delivering it under pressure to the inlet 20 of the vehicle chamber 18 when the vehicle is supported and held in place on the launcher. The launcher also includes a latch mechanism 30 for manually releasing the vehicle after the chamber has been sufficiently expanded.

When the vehicle is released from the launcher, the chamber 18 exerts a substantial contractive force on the water within the chamber to expel it outwardly, rearwardly through the outlet 20 to thereby propel the vehicle forwardly at a rapid rate.

Now to consider the illustrated apparatus 10 in further detail The toy vehicle 12 is best shown generally in FIG. 1. The frame 16 includes a generally horizontal longitudinally extending platform or base plate 32 and a vertical upright plate or portion 34 located toward the rear of the platform. Generally centrally of the upright portion 34 (see FIGS. 2, 4 and 7) there is a horizontally and longitudinally extending tubular sleeve 36 having a central cylindrical opening 38. The sleeve 36 extends both forwardly and rearwardly from the upright portion 34. The rearward portion of the sleeve 36 defines the outlet end or nozzle 40 of the chamber outlet 20. A chamber defining member 42 and the enclosure 22 are mounted to the forwardly face of the upright portion 34 and extend forwardly therefrom. More particularly, the chamber forming member 42 has a generally tubular body 44 disposed with its axis extending generally horizontally front to rear. The chamber body 44 is open at is rearward end 46, and closed in a generally hemispherical configuration at is forward end 48. The rear end 46 of the chamber body 44 is proportioned to fit over the forwardly extending end portion 50 of the tubular sleeve 36. This places the central opening 38 of the sleeve 36 in communication with the interior of the chamber member 42. The rear end 46 of the chamber body 44 has a radially outwardly extending annular flange 52 that abuts against the forward face of the frame upright portion 34. This flange 52 assists in the chamber forming member 42 being held in place while the chamber is expanded. In this connection, the enclosure 22 is generally bulbous in shape, and its rear end 54 is open and configured and arranged to fit over and engage the rear end of the chamber forming member. More particularly the rear end of the enclosure has a rearwardly facing upright annular surface 58 (FIG. 4) that abuts the forwardly facing annular surface of the flange 52. The rear end of the enclosure also has an annular radially inwardly facing surface 60 positioned to engage the exterior annular area of the chamber body just forwardly of the flange 52. The upright frame portion 34 is provided with a forwardly extending annular ring portion 62 that surrounds the outside of the rear end of the enclosure to position and maintain that rear end of the enclosure in its locking relationship with the chamber forming member.

The vehicle frame 16 and the enclosure 22 are desirably made of a rigid material such as a molded plastic (e.g., polystyrene or polypropolene). The chamber forming member 42 is made of a resilient, expandable and contractible material such as rubber. The walls of the chamber forming member rubber. The walls of the chamber forming member are quite thick to serve their intended function of applying a large contractive force on water which has been forced into and expanded the chamber forming member. A chamber forming member made of pure latex and having the following dimensions has been found to operate very satisfactorily: an external length of about one inch; an external diameter of about 0.440 inch; an internal diameter of about 0.210 inch; and a wall thickness of about 0.115 inch.

The illustrated enclosure 22 has a central generally cylindrical portion 64 disposed around a horizontal front to rear extending axis. The enclosure has a generally hemispherical shape at its closed forward end 65. Its rearward end 54 begins to curve radially inwardly so as to form a partial hemispherical surface, however that end is open and formed, as described above, to allow the chamber forming member 42 to extend into the enclosure and to operate to hold the chamber forming member in place.

As shown in FIG. 1, the toy vehicle may include freely rotatable wheels 66 mounted on the frame 16. The frame may also support decorative parts such as a vehicle outer body or motor 68 and/or a driver character FIG. 70.

The upright frame portion 34 includes a rearwardly extending mounting sleeve 72 that is generally cylindrical around a horizontal front to rear axis. The walls of the mounting sleeve 72 are somewhat tapered from thicker to thinner in the rearward direction. Internally, the sleeve 72 forms a generally cylindrical but radially outwardly flaring surface 74 that expands in the rearward direction. The mounting sleeve 72 assists in positioning and mounting the vehicle 12 on the launcher 14 as will be explained more fully below. The illustrated launcher 14 includes the self-standing base 24 which is supported and elevated above a supporting surface by a pair of spaced apart depending side supports 76 that extend forward to rearward of the device. Atop the rear portion of the base 24 is the liquid containing reservoir 26. The resevoir may have a suitable cover (not shown) that can be opened for filling the reservoir and closed to keep the water from spilling out of the reservoir.

Mounted atop the base 24, intermediate the front and rear, is the pump mechanism 28. As shown in FIG. 2, the illustrated pump mechanism 28 has a generally tubular upright pump chamber 80 which receives a vertically reciprocating pump plunger 82 having a handle or knob 84 at its upper end. The plunger 82 may be provided with suitable sealing means such as an o-ring (not shown). The lower portion 87 of the pump chamber 80 is in communication to the rear with a rear intermediate chamber 88. Pump portion 87 is also in communication to the front with a front intermediate chamber 90. The rear intermediate chamber 90 is also in communication to the rear with the reservoir 26 through an opening 92. There is a one-way rear valve 94 in the opening 92 (shown in broken line in its open position) which permits forward liquid flow from the reservoir (as indicated by arrows), but limits rearward flow back into the reservoir from the rear intermediate chamber 90.

There is also an opening 96 between the pump chamber and the forward intermediate chamber 88. Opening 96 has a one-way front valve 98 (shown in broken line in its open position) which allows forward liquid flow (as indicated by arrows), but not rearward flow. Thus, when the pump plunger 82 is raised (see broken line position FIG. 1), water is drawn from the reservoir through the rear valve 94 into the rear intermediate chamber 88 and into the pump chamber 80; the front valve 98 is drawn closed. When the pump plunger 82 is depressed (solid line position in FIG. 1 and as shown in FIG. 2), that water is pushed through the front valve 98 into the forward intermediate chamber 90; it is restricted from returning to the reservoir by the rear valve 94. A stop 99 limits downward movement of the plunger 82.

Figure 4:
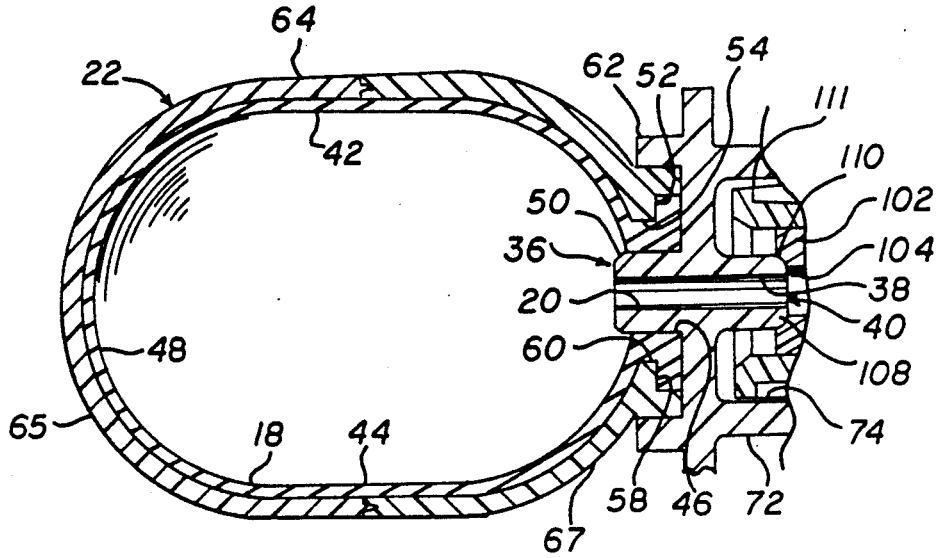
FIG. 4 is a further enlarged sectional view of a portion of FIG. 2, with the chamber in its expanded condition.

There is an opening 100 at the forward end of the forward intermediate chamber 90 that leads to a seating member or ring 102. The seating member 102 has a central opening 104 that is in communication with the front opening 100 from the front intermediate chamber 90. The illustrated seating member 102 (see also FIGS. 4 and 7) is in the form of a ring or doughnut shaped piece, made from a somewhat giving or resilient material such as rubber or flexible plastic, e.g., polyurathane. The illustrated seating ring 102 is secured in a forwardly open cavity formed at the forward end of the launcher base. The forward facing annular edge of the sealing ring opening 104 is generally beveled or formed to provide a seat 108 (FIG. 4). The nozzle end 40 is also formed or bevelled around its annular outer edge to provide an annular seating surface 110 that generally conforms to the shape of the seat 108 of the seating ring 102. When the vehicle is mounted on the launcher, the seating surface 110 of the nozzle end 40 abuts and forms a seal with the seat 108 of the seating ring. The central opening 104 of the sealing ring is in communication with the central opening 38 of the nozzle 40. In this way, water from the forward intermediate chamber 90 can pass through the seating ring opening 102 and through the nozzle opening 38 into the chamber forming member 42 when the vehicle is mounted on the launcher. Thus, water can be pumped from the reservoir 26 into the chamber forming member 42 to expand the chamber to its expanded condition as shown generally in FIG. 4. The amount of expansion is generally limited by the enclosure 22.

The toy vehicle 12 is held in this position by the latch mechanism 30. In this connection, the launcher base 24 is formed with a pair of forward facing concentric tube sections 111, 113. An annular cavity is formed between the tube sections 111, 113 for receiving therein the rearwardly extending mounting sleeve 72 on the vehicle. This positions the vehicle 12 on the launcher 14 with the vehicle nozzle end 40 and its seating surface 110 aligned with the launcher seating ring 102 and its seat 108. The cylindrical outer surface on the inner tube section 111 is somewhat radially inwardly tapered in the forward direction from larger to smaller to facilitate receiving the tapered surface 74 of the mounting sleeve 72 of the vehicle thereon. This also facilitates the ready release at launch of the mounting sleeve inner surface 74 from the platform tube section mating surface. A coil compression spring 115 is disposed in the annular cavity between launcher tube sections 111, 113. The spring 115 exerts a forward bias on the rear edge of the vehicle sleeve 72 when the vehicle is mounted on the launcher.

Figure 8:
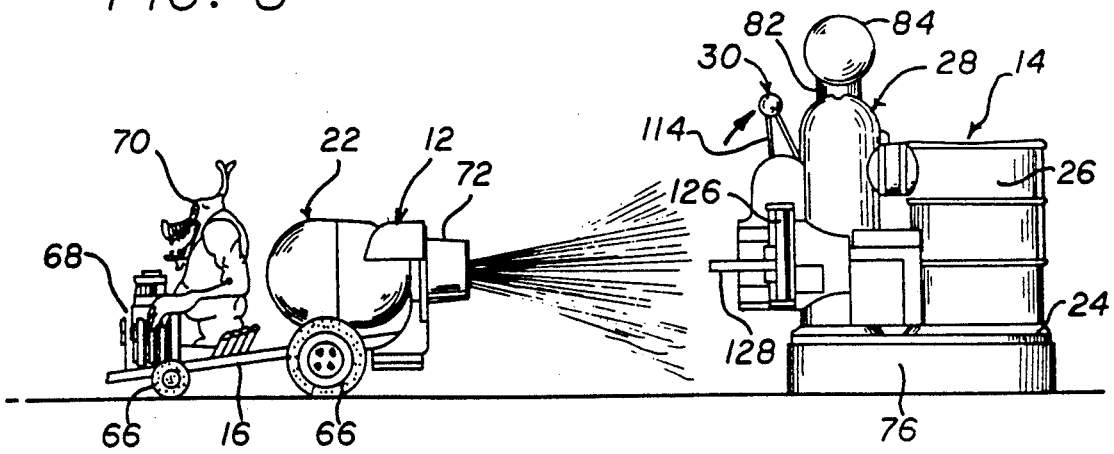
FIG. 8 is a side elevation of the apparatus showing the vehicle after its release from the launcher.

In general, when the vehicle is mounted on the launcher, it is releasably locked in place by the latch mechanism 30. This allows the child-user to pump a sufficient quantity of water into the chamber to achieve the desired expansion of the chamber before the vehicle is released. Only then is the vehicle manually released by the child-user. When this mechanical lock is disconnected, the spring 115 pushes the vehicle forwardly and clear of the launcher. Generally simultaneously, the substantial force of the expanded chamber body 44 on the water in the chamber forces that water (through the nozzle 40) against the water in the ring opening 104 (and rearwardly thereof in the forward intermediate chamber 90) to cause the vehicle to, in effect, be pushed forward and away from the launcher. As this happens, the continued force of the chamber wall 44 on the water, expelling it outwardly rearwardly through the nozzle 40, propels the vehicle forwardly at a rapid rate, as shown in FIG. 8.

Figure 5:
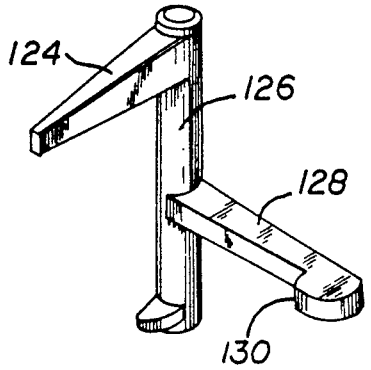
FIG. 5 is a perspective view of a latch element of the apparatus.
Figure 6:
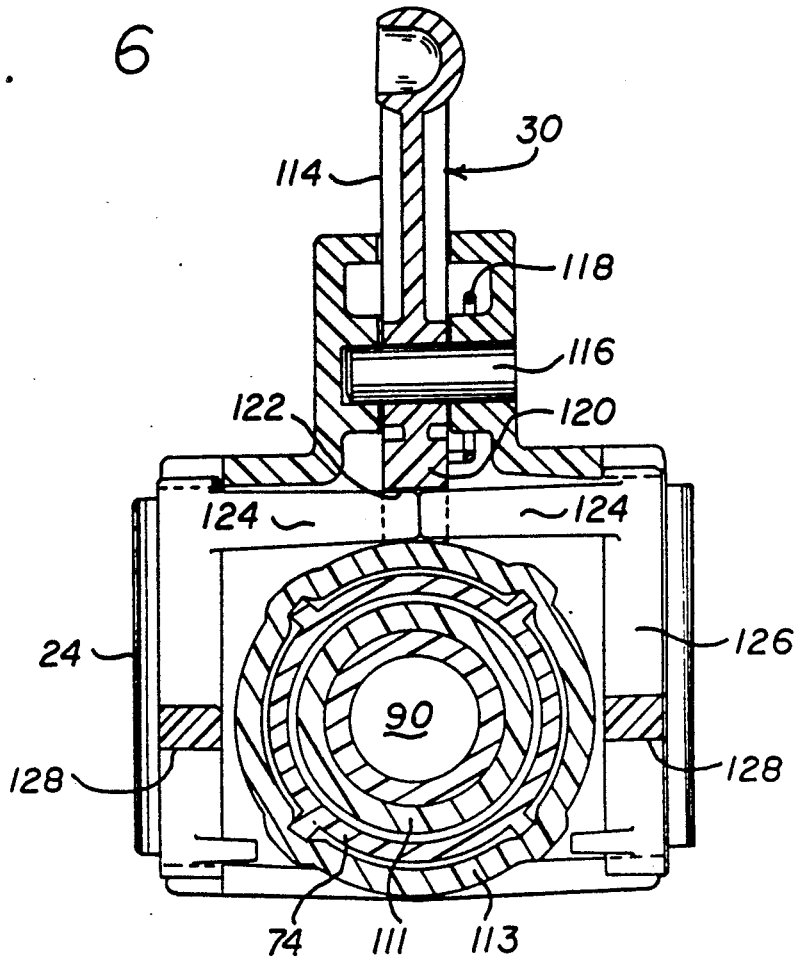
FIG. 6 is transverse sectional view taken generally along line 6—6 of FIG. 1.

Referring to the release mechanism 30 in further detail, FIGS. 2 and 6 show a latch release lever 114 pivotally mounted on a transverse horizontally extending shaft 116. A wound wire spring 118 mounted around a hub 119 of the launcher base 24 biases the lever 114 counter-clockwise as seen in FIG. 2 The pivoted lever 114 has a depending extension 120 that has a transverse slot 122 (FIGS. 2 and 6). The slot 122 receives the ends of a pair of horizontally transversely extending control arms 124. The control arms 124 are each fixed to the top of a vertical side shaft 126 rotably mounted at one side of the outer tube section 113. FIG. 5 shows one of the parts that provides a side shaft 126 and an associated control arm 124. Each of these parts also has fixed, intermediate its height, a forwardly horizontally extending latch arm 128. Each latch arm 128 has an inwardly directed latch finger 130. The latch arms 128 are biased inwardly toward one another by the spring 118 acting on the lower extension 120. This position of the latch arms 128, shown in solid line in FIG. 7, causes the latch fingers 130 to engage opposed side edges 132 of the upright vehicle frame portion 34 to lock the vehicle to the launcher against forward movement.

When the toy vehicle is loaded onto the launcher, the opposed side edges 132 of the upright vehicle frame section 34 engage rounded caming surfaces 134 on the latch fingers 130 to move the latch fingers sufficiently outwardly against the spring bias to allow the side edges 132 to pass rearwardly. The spring bias then returns the latch fingers 130 to the latching positions shown in FIG. 7 (solid line).

Figure 7:
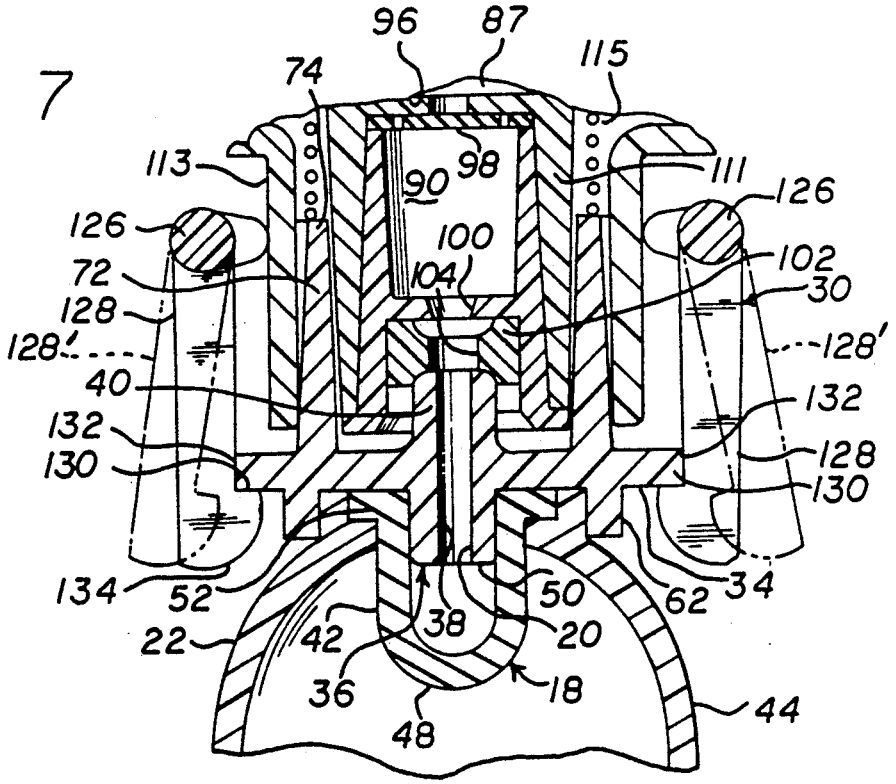
FIG. 7 is a longitudinal sectional view taken generally along line 7—7 of FIG. 1.

When the lever 114 is subsequently pushed upward or clockwise as viewed in FIGS. 1 and 2 (see broken line position 114' of lever in FIG. 1), the control arms 120 are pivoted forwardly and the latch arms 128 are spread to the broken line positions 128' of FIG. 7. This disengages the latch fingers 130 from the side edges 132, and thus releases the toy vehicle for forward movement. The coil compression spring 115 can now expand to give the vehicle the thrust forward. At about the same time, the contractive force of the chamber body 44 forces the water in the chamber out rearwardly through the nozzle 40 to drive the vehicle forwardly.

Various modifications can be made in the specific structure shown without departing from the spirit and scope of the invention as set forth in the following claims.

What is claimed is:

1. A self propelled toy vehicle and launcher combination utilizing liquid under pressure to propel the vehicle, said toy vehicle having a front and a rear end and comprising;

a frame, means defining an expandable and contractible chamber mounted on the frame, said chamber defining means having an entrance-exit facing toward the rear end of the vehicle, said entrance/exit being adapted to receive a quantity of liquid such as water under pressure therethrough and into the chamber defining means to expand the chamber defining means a substantial amount, said chamber defining means being proportioned and arranged so that when it is so expanded, it will exert substantial and sufficient force on the liquid in the chamber to expel the liquid from the chamber through the entrance/exit at a substantial velocity in the direction of the rear end of the vehicle to thereby propel the vehicle in the opposite forward direction at a substantial velocity, and a rigid outer enclosure mounted on the frame and generally surrounding the expandable chamber defining means, said launcher comprising means to releasibly maintain the liquid in the chamber until the chamber is expanded said substantial amount.

2. The toy vehicle of claim 1 wherein the chamber defining means is a single bulbous part made from a substantially expandable and contractible material.

3. The toy vehicle of claim 2 wherein said part is made of rubber.

4. The toy vehicle of claim 2 wherein said part is open at one end, and has a thick tubular central wall portion.

5. The toy vehicle of claim 4 wherein said open end has an annular integrally formed flange portion that extends radially outwardly for attachment of the part to the frame.

6. The toy vehicle of claim 5 wherein said enclosure engages said flange portion to secure said chamber defining part in place while it is being expanded.

7. The launcher of claim 1 also comprising means to releasibly restrain the vehicle against forwarding movement until the chamber is substantially expanded.

8. A toy vehicle and launcher combination comprising:

a self propelled toy vehicle for use in combination with a source of liquid under pressure, said toy vehicle having a front and a rear end, said vehicle comprising;

a frame, means defining an expandable and contractible chamber mounted on the frame, said chamber defining means having a thick wall and having an entrance-exit facing toward the rear end of the vehicle; and a launcher comprising, means for a releasibly holding the vehicle against forward movement, means for providing liquid such as water, under pressure to the entrance/exit of the chamber defining means for filing and expanding substantially the chamber defining means, means for releasibly maintaining the water in the expanded chamber defining means, and means for generally simultaneously releasing the vehicle from the launcher holding means and releasing the liquid from the chamber defining means, the chamber defining means being proportioned and arranged so that when the liquid is released from the expanded chamber defining means, the chamber defining means exerts substantial and sufficient force on the liquid to expel it outwardly through the entrance/exit to thereby propel the vehicle forwardly at a substantial velocity, the liquid being expelled in a slow steady sustained stream relative to the stream that would be provided by a gas of comparable quantity.

9. The apparatus combination of claim 8 wherein said liquid providing means comprises a reservoir and a pump.

10. The apparatus combination of claim 9 including means defining a passageway that leads from the pump to a forward opening, said passageway defining means providing an outlet seat at the forward opening proportioned and arranged to engage and form a seal with the chamber entrance/exit on the vehicle when the vehicle is mounted on the launcher, the passageway then being in liquid communication with the vehicle chamber.

11. The apparatus combination of claim 10 wherein the releasible holding means is manually releasible by the child-user to allow the vehicle chamber entrance/exit to separate from the outlet seat on the launcher.

12. The apparatus combination of claim 8 further including biasing means that mechanically propels the toy vehicle forwardly when the vehicle is released by the holding means.

13. A self propelled toy vehicle for use in combination with a source of liquid under pressure, said toy vehicle having a front and a rear end and comprising;

a frame , means defining an expandable and contractible chamber mounted on the frame, said chamber defining means having an entrance-exit facing toward the rear end of the vehicle, said entrance/exit being adapted to receive a quantity of liquid such as water under pressure therethrough and into the chamber defining means to expand the chamber defining means a substantial amount, said chamber defining means being proportioned and arranged so that when it is so expanded, it will exert substantial and sufficient force on the liquid in the chamber to expel the liquid from the chamber through the entrance/exit at a substantial velocity in the direction of the rear end of the vehicle to thereby propel the vehicle in the opposite forward direction at a substantial velocity, said chamber defining means defining a single bulbous part made from a substantially expandable and contractible material, said part being open at one end and having a thick tubular central wall portion, said open end having an annular integrally formed flange portion that extends radially outwardly for attachment of the part to the frame, and a rigid outer enclosure mounted on the frame and generally surrounding the expandable chamber defining means, said enclosure engaging said flange portion of said chamber defining part to secure said part in place while the part is being expanded.

* * * * *